United States Patent [19]

Harris et al.

[11] Patent Number: 4,629,379

[45] Date of Patent: Dec. 16, 1986

[54] ADAPTER PALLET SYSTEM

[75] Inventors: Foster R. Harris, Nashua, N.H.; Martin S. Traister, Lexington, Mass.

[73] Assignee: The United States of America as represented by the Secretary of the Air Force, Washington, D.C.

[21] Appl. No.: 680,611

[22] Filed: Dec. 11, 1984

[51] Int. Cl.[4] ..... B60P 7/13

[52] U.S. Cl. ..... 410/77; 244/118.1; 244/137 R; 248/503; 410/52; 410/84

[58] Field of Search ..... 410/2, 46, 52, 69–71, 410/77–82, 84, 92, 156; 220/1.5, 23.4; 244/118.1, 137 R, 137 L; 108/51.1; 248/500, 503

[56] References Cited

U.S. PATENT DOCUMENTS

| | | | |
|---|---|---|---|
| 2,447,542 | 8/1948 | Seward | 108/53.3 |
| 3,093,092 | 6/1963 | Martin et al. | 244/137 L X |
| 3,439,822 | 4/1969 | Korodi | 410/52 |
| 3,480,174 | 11/1969 | Sherwood | 220/1.5 |
| 3,690,485 | 9/1972 | Fischer et al. | 108/51.1 X |
| 3,703,870 | 11/1972 | Walton | 108/50 |
| 3,774,551 | 11/1973 | Sweger | 410/70 |
| 4,049,135 | 9/1977 | Glassmeyer | 410/82 X |
| 4,077,590 | 3/1978 | Shorey | 410/77 |
| 4,095,769 | 6/1978 | Fengels | 248/346 |
| 4,108,326 | 8/1978 | Bertolini | 220/23.4 X |

FOREIGN PATENT DOCUMENTS

| | | | |
|---|---|---|---|
| 2487777 | 2/1982 | France | 244/137 R |

*Primary Examiner*—Randolph A. Reese

*Attorney, Agent, or Firm*—Jacob N. Erlich; Donald J. Singer; James E. Maslow

[57] ABSTRACT

A bifurcated adapter pallet system for providing an interface between the U.S. Department of Defense 463L configured carrier and International Organization for Standardization (ISO) container. Each adapter has mounting faces to attach to an ISO container at the container corner fittings and 463L tongues for restraint by 463L equipment. The ISO/463L adapter pallet facilitates efficient and appropriate tiedown and transportation of ISO cargo by means of vehicles equipped with the 463L handling system.

4 Claims, 6 Drawing Figures

ADAPTER PALLET SYSTEM

STATEMENT OF GOVERNMENT INTEREST

The invention described herein may be manufactured and used by or for the Government for governmental purposes without the payment of any royalty thereon.

BACKGROUND OF THE INVENTION

The present invention relates to adapter pallets, and more particularly, to a bifurcated pallet for adapting between ISO containers and vehicles equipped with the U.S. Department of Defense 463L materials handling system.

The U.S. Department of Defense (DoD) is a formidable advocate of containerization. Development of a capability to efficiently handle International Organization for Standardization (ISO) containers and tactical shelters is thus a DoD priority. Presently, the DoD 463L materials handling system supports cargo air transport. FIG. 1 discloses aircraft and cargo vehicle roller diameters and spacing dimensions employing the 463L system. However, there is no standardization for containers in such arrangement such as available through use of the ISO program, and ISO containers do not readily adapt to the 463L system. In fact, at the present time, transport of ISO cargo by means of 463L equipped vehicles is make-shift and time-consuming, employing chains or like means for cargo tiedown.

The ISO concept is to standardize corner fittings and container structural dimensions to facilitate efficient and uniform handling of containers. As seen in FIG. 2, a typical general purpose $8\times8\times20$ ISO container comprises corner fittings, fork lift slots, and the container body. The corner fittings cooperate with the container body in a manner such that the fittings are raised a certain distance F above the body surface, as indicated in the figure. Each corner fitting comprises a cavity having a pawl-receiving mouth, which functions as described below.

The 463L system employs pallets, typically $96''\times108''$, and in part configured as seen in the partial view of FIG. 3. Most significant for descriptive purposes herein is the 463L pallet tongue with dimensions as given. The tongue cooperates with a rail restraint, the latter of which is integral with the transport vehicle, for securing the 463L pallet to the vehicle.

SUMMARY OF THE INVENTION

The presently disclosed bifurcated adapter pallet system provides an interface between the 463L and ISO systems. Each adapter has mounting faces to attach to an ISO container at the container corner fittings and tongues for restraint by 463L equipment. The ISO/463L adapter pallet therefore facilitates efficient and appropriate tiedown and transportation of ISO cargo by means of vehicles equipped with the 463L handling system.

The pallet is unique in that it features a bifurcated design, with one of a pair of interchangeable adapter sections affixable on each of two opposed sides of an ISO container and where the need for additional external restraints is obviated. The two-part pallet can preferably accommodate ISO containers in lengths of 5, 10, and 20 feet. An alternative embodiment would accommodate $6\frac{2}{3}$, $13\frac{1}{3}$ and 20 foot containers.

It is therefore an object of the present invention to provide an interface between ISO units and the 463L system.

It is a further object to provide a bifurcated adapter pallet for use between ISO units and the 463L system which pallet is adaptable to several ISO unit configurations.

It is a further object of the present invention to provide tiedown means for adapting ISO cargo to 463L transporters and which means is both inexpensive and easy to employ.

DESCRIPTION OF THE DRAWINGS

The invention will be more clearly understood by reference to the following detailed description of a preferred embodiment thereof in conjunction with the accompanying drawings, in which.

DETAILED DESCRIPTION OF THE PREFERRED EMBODIMENT

The present invention comprises an adapter pallet system employing two like adapter sections for each ISO tiedown. An exemplary adapter 10 is shown in the partial and broken perspective view of FIG. 4 and will be understood to be preferably formed out of a single section of extruded material, such as out of aluminum.

Figure 4:
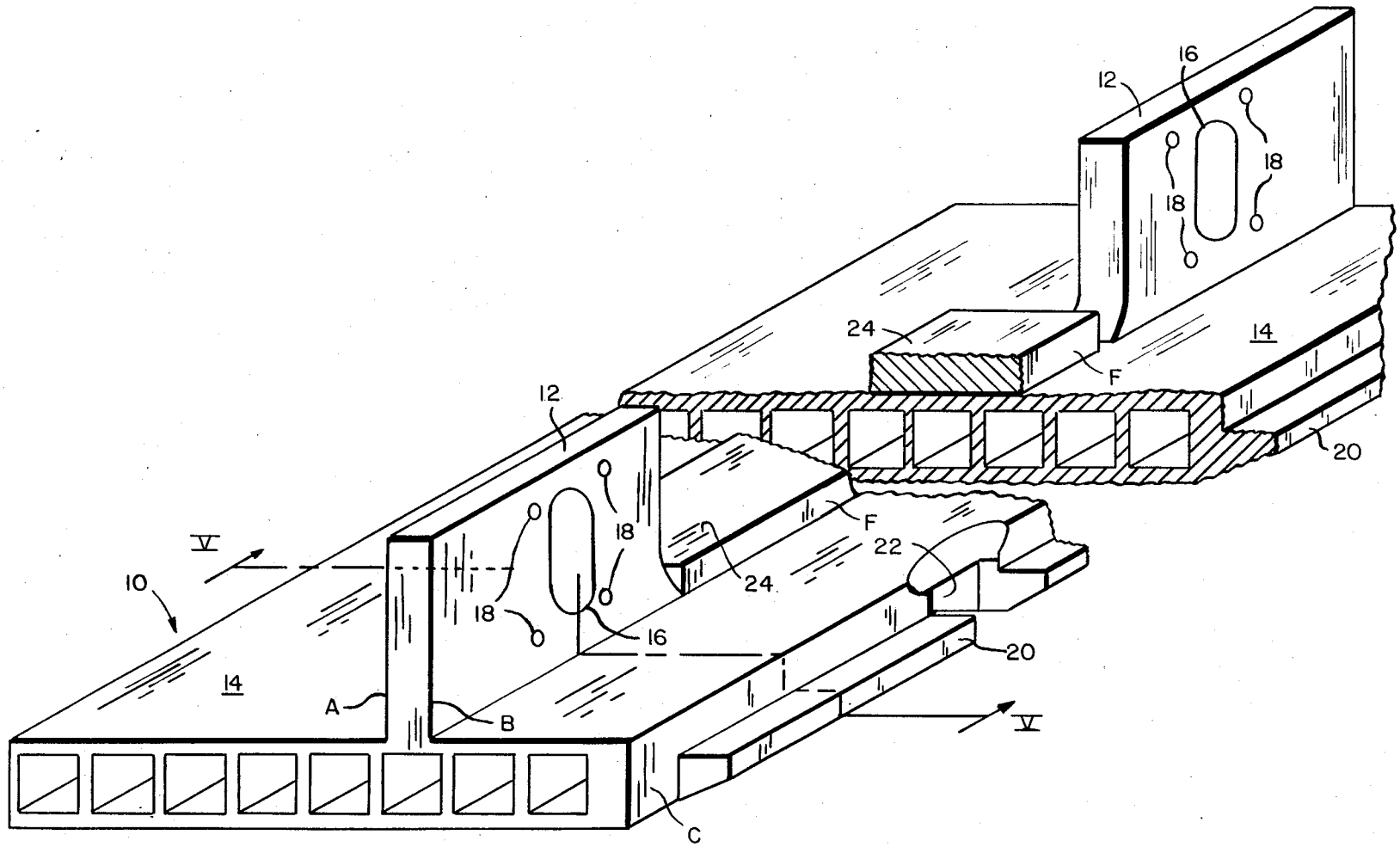
FIG. 4 is a broken partial perspective view of a preferred adapter in practice of the present invention.

As seen in FIG. 4, adapter 10 comprises mounting flanges 12, each of which flanges is raised perpendicular to the horizontal surface 14 of the body of adapter 10. A mounting cavity 16 is formed within each flange 12, communicating therethrough between flange walls A and B along an axis above and parallel to surface 14.

Figure 1:
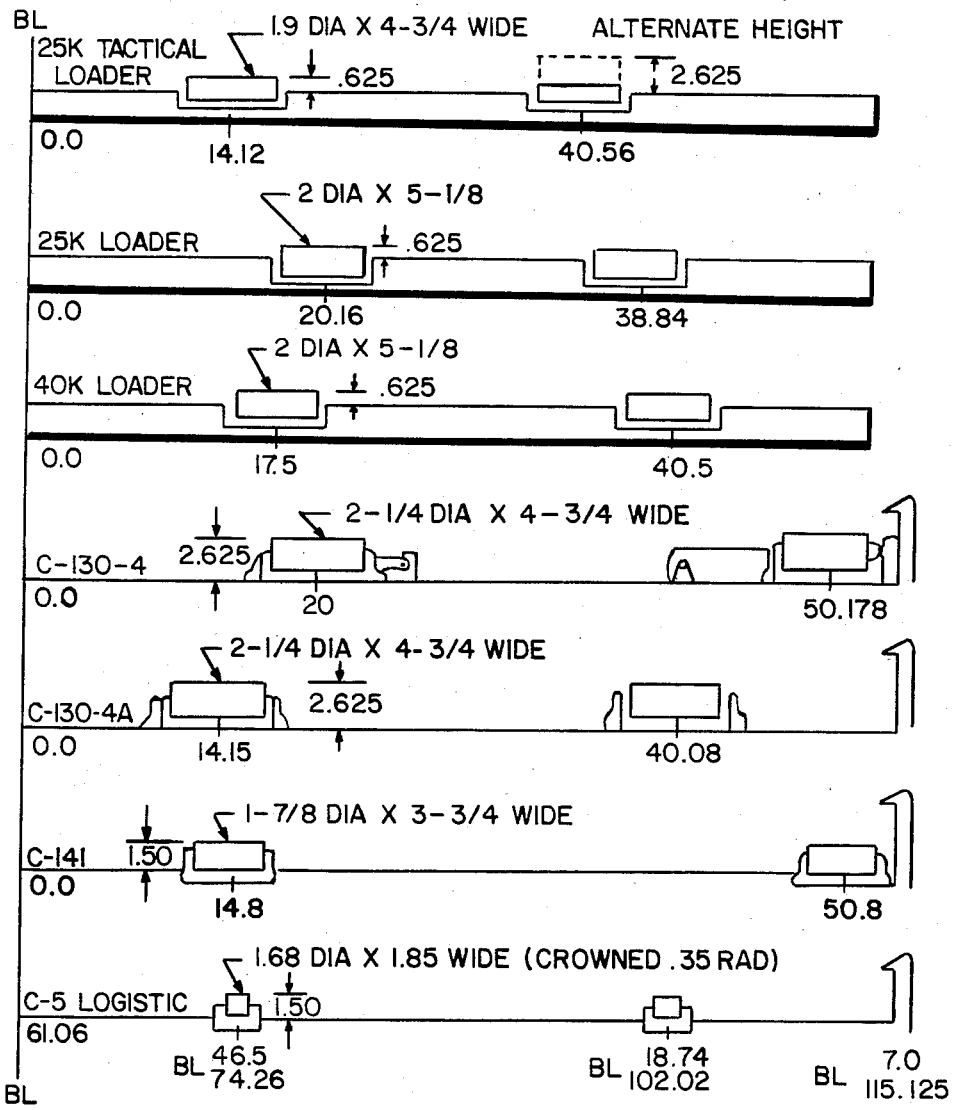
FIG. 1 is a chart showing existing 463L configurations on several vehicles, where "BL" is the centerline of the vehicle, with dimensions in inches.
Figure 2:
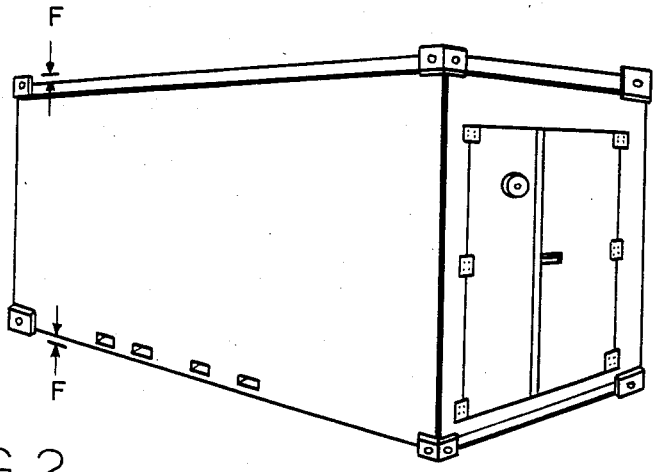
FIG. 2 is a perspective view of an exemplary ISO container.

Adapter 10 is further provided with a 463L-configured tongue extending outwardly from the adapter sidewall C. The tongue has 463L dimensions accordingly shown in FIG. 2. Tongue 20 extends approximately the length of adapter 10 and has at least one pocket or interruption 22 defined therein for cooperation with a 463L tiedown ring. In addition, shim plate 24 is provided on surface 14 having an elevation F corresponding to the amount by which the corner fittings of an ISO container extend beyond the ISO body.

Figure 3:
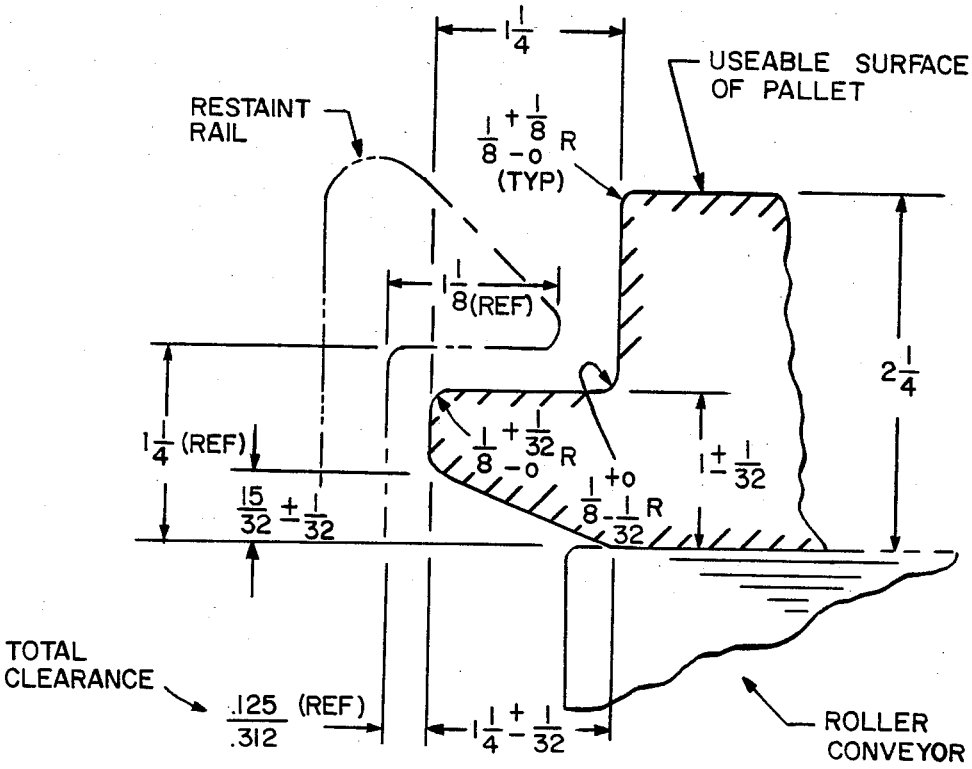
FIG. 3 is a partial side cross section of a 463L pallet.
Figure 5:
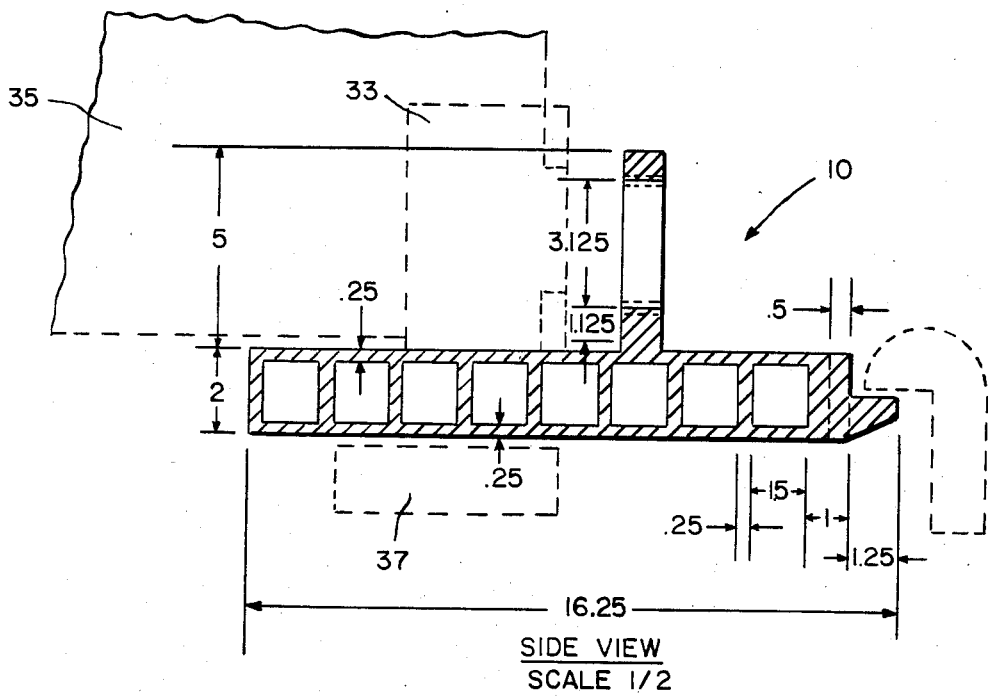
FIG. 5 is a sectional view taken along lines V—V of FIG. 4 showing the invention in cooperation with a container and aircraft roller.

Referring now to FIG. 5, a side view of the inventive adapter 10 is shown in cooperation with an exemplary corner fitting 33 of an ISO container 35 and an exemplary 463L aircraft roller 37 such as one of the rollers shown in FIG. 3. The adapter 10 is tied down to the aircraft by at least one 463L restraint rail 39.

Figure 6:
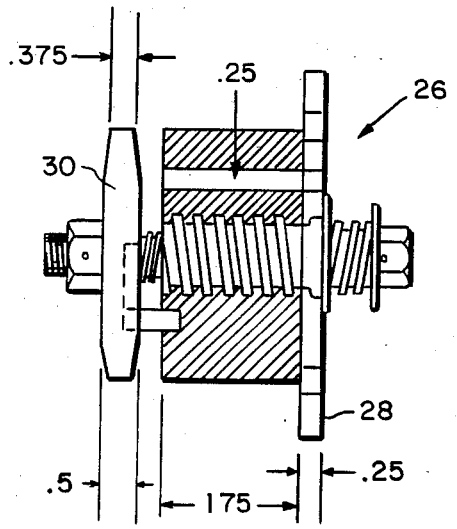
FIG. 6 is a locking device for use with the embodiment of FIG. 3.

The ISO container corner fitting defines a mouth-like locking cavity which is disposed to receive a locking device of the present invention to securely affix the adapter 10 to the ISO container. A known locking device 26 is shown in FIG. 6 having a body plate 28. Locking device 26 is coupled at its plate 28 to flange 12 at mounting cavity 16 by means of screw-receiving openings 18. The locking device 26 is provided with a mounting pawl 30 which functions in a manner described below.

It will now be appreciated that a pair of adapters 10 will interface between (1) respective 463L restraint rails and rollers of a 463L-equipped vehicle and (2) respective opposed sides of an ISO configured container. Attachment of two of the present ISO/463L adapters to an ISO shelter is thus accomplished as follows: First, the ISO container is appropriately elevated and a respective adapter 10 is slid underneath it at each of two opposite sides of the container. For each adapter, two mounting flanges 12 abut the ISO container body and the 463L tongue 20 points out. Next, a respective mounting pawl 30 of a respective locking device 26 is inserted through the oval mounting cavity 16 in each of the two mounting flanges 12 of the adapter and into the mouth of the locking cavity of the ISO corner fitting adjacent thereto. The locking device 26 is then tightened whereby the pawl 30 locks and tightens against the interior of the locking cavity mouth. The container and adapters, as a single unit, are now treatable as any other 463L palletized cargo.

While the present invention has been described in connection with rather specific embodiments thereof, it will be understood that many modifications and variations will be readily apparent to those of ordinary skill in the art and that this application is intended to cover any adaptation or variation thereof. Therefore, it is manifestly intended that this invention be only limited by the claims and the equivalents thereof.

What is claimed is:

1. An adapter pallet system for interfacing an ISO container with a DoD 463L configured carrier, wherein said ISO container has corner fittings, each of said corner fittings extending a preselected distance beyond the body of said ISO container, and each of said corner fittings having a locking cavity therein, said adapter pallet system comprising a pair of adapters for engaging opposite sides of said body of said ISO container, wherein each of said adapters includes:

a base, said base having a substantially horizontal surface thereon;

an element extending outwardly from said base for engaging a restraint rail on said DoD 463L configured carrier;

a pair of spaced apart flanges extending perpendicular to said surface of said base, each of said flanges having a cavity therein, said cavity being positioned along an axis above and parallel to said base; and a shim plate, said shim plate being of a predetermined thickness above said surface of said base and interposed between said pair of flanges, said predetermined thickness of said shim plate being substantially equal to said preselected distance each of said corner fittings extends beyond the body of said ISO container;

whereby means can be inserted through each of said cavities within said flanges of each of said adapters and through each of said locking cavities in said corner fittings of said ISO container, respectively, in order to lock said adapters to said ISO container.

2. An adapter pallet system as defined in claim 1 wherein said outwardly extending element is of a length substantially equal to the length of said adapter and has an interruption therein to accommodate at least one tie down ring on said DoD 463L configured carrier.

3. An adapter pallet system as defined in claim 2 further comprising means for locking said adapters to said ISO container.

4. An adapter pallet system as defined in claim 3 wherein said locking means are in the form of a plurality of locking devices, each of said locking devices having means for securing said locking devices to said flanges.

* * * * *